United States Patent [19]

Rottier

[11] 3,986,076

[45] Oct. 12, 1976

[54] HIGH EFFICIENCY SUPPLY CIRCUIT FOR AN ELECTRIC DISCHARGE LAMP

[75] Inventor: Jacob Rottier, Eindhoven, Netherlands

[73] Assignee: U.S. Philips Corporation, New York, N.Y.

[22] Filed: Feb. 24, 1975

[21] Appl. No.: 552,591

[30] Foreign Application Priority Data

Mar. 1, 1974 Netherlands ..... 7402779

[52] U.S. Cl. ..... 315/99; 315/106; 315/244; 315/DIG. 5

[51] Int. Cl.[2] ..... H05B 41/233

[58] Field of Search ..... 315/94, 98–100, 315/105–107, 244, DIG. 2, DIG. 5

[56] References Cited

UNITED STATES PATENTS

| | | | |
|---|---|---|---|
| 2,056,629 | 10/1936 | Uyterhoeven et al. | 315/244 X |
| 2,482,894 | 9/1949 | Bird | 315/244 X |

*Primary Examiner*—Siegfried H. Grimm
*Attorney, Agent, or Firm*—Frank R. Trifari; Bernard Franzblau

[57] ABSTRACT

A ballast impedance for an electric discharge lamp comprises an inductor and a capacitor connected in series with the lamp across AC input terminals. The lamp operating voltage is less than 20 percent of the AC supply voltage. The values of L and C are chosen so that the ballast has a net capacitive character and to provide a resonance between 3.5 and 4 times the frequency of the AC supply voltage.

7 Claims, 3 Drawing Figures

HIGH EFFICIENCY SUPPLY CIRCUIT FOR AN ELECTRIC DISCHARGE LAMP

Figure 1:
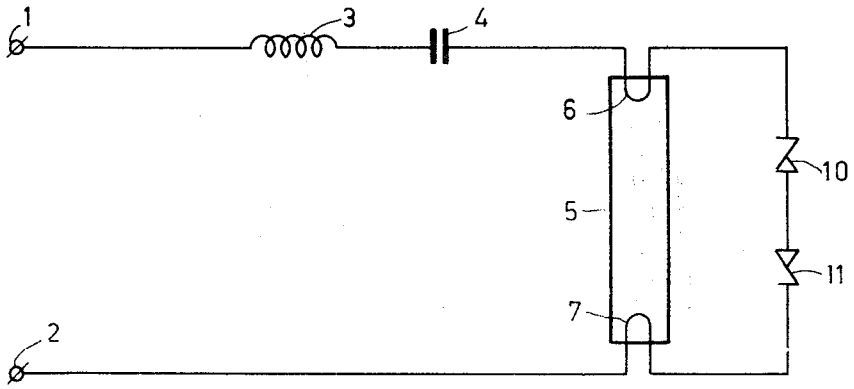

The invention relates to an arrangement provided with a gas and/or vapour discharge lamp, comprising two input terminals connected by a series arrangement of an inductor, a capacitor and the lamp, the input terminals being intended to be connected to an alternating voltage source, the combination of the inductor and the capacitor having a capacitive character at the frequency of the alternating voltage source.

A known arrangement of the kind mentioned above is described, for example, on pp. 135 and 136 of the book "Florescent lamps", Elenbaas, Philips Technical Library, 2nd. ed. 1971.

A drawback of the known arrangement is that the value of the inductor — expressed, for example, in Henry — should be relatively large to ensure a satisfactory stabilization of the current through the discharge lamp. This necessitates an inductor having relatively large dimensions.

An object of the invention is to use a relatively small inductor in an arrangement of the kind described in the preamble while maintaining an acceptable stabilization of the discharge lamp.

According to the invention, an arrangement provided with a gas and/or vapour discharge lamp comprising two input terminals connected by a series arrangement of an inductor, a capacitor and the lamp, in which the input terminals are intended to be connected to an alternating voltage source and in which the combination of the inductor and the capacitor has a capacitive character at the frequency of the alternating voltage source is characterized in that the operating voltage of the lamp is less than 20 percent of the effective value of the voltage of the alternating voltage source, and that the condition:

$$\tfrac{1}{8} < \pi f \sqrt{LC} < 1/7$$

is satisfied, wherein:

$f$ represents the frequency (in Herz) of the alternating voltage source;

$L$ is the value of the inductor (in Henry); and $C$ is the value of the capacitor (in Farad).

An advantage of this arrangement is that the value L of the inductor, hence the dimensions of this inductor, can be chosen to be relatively small.

The following will serve for the purpose of explanation. Prior to this invention the value of L and C of the ballast was generally chosen to be such that for a frequency $f$ of the alternating voltage source there applied that: $(1/2\pi fC) = 2(2\pi fL)$, i.e. the reactance of the capacitor was twice that of the inductor. This meant that resonance occurred at a frequency of approximately $f\sqrt{2}$. For a frequency $f$ of 50 Hz occurring in practice, this resonant frequency then was approximately $50\sqrt{2} = 70$ Hz.

It now has been found by the inventor that in discharge lamps with an operating voltage of less than 20 percent of the voltage of the alternating voltage source first a range of unstable operation of the lamp is passed in the case of a reduction of the value L of the inductor — combined with such a simultaneous change of the capacitance that the lamp current remains constant — i.e. in the case of an increase in the resonant frequency. Unstable operation is understood to mean operation with a relatively large dark time interval after each zero crossing of the lamp current. The lamp emits relatively little light in this range.

It is, however, surprising that the lamp again operates in a stable range when the resonant frequency is considerably increased, namely at a resonant frequency of between 3.5 and 4 $f$, where $f$ represents the frequency of the alternating voltage source. This stable operation is presumably to be ascribed to the fact that higher harmonics of the current cause the total lamp current to be reasonably sinusoidal.

In the said lamps having a relatively low operating voltage with respect to the voltage of the alternating voltage source, the relatively low value of L of the inductor in an arrangement according to the invention is furthermore sufficient for contributing to a usable voltage for the reignition of the lamp after each zero crossing off the lamp current.

The requirement as to the resonant frequency may be defined by the following formula:

$$3.5 f < \frac{1}{2\pi\sqrt{LC}} < 4f,$$

which after some transformation may be written as $\tfrac{1}{8} < \pi f \sqrt{LC} < 1/7$.

The discharge lamp in an arrangement according to the invention may be, for example, a short-arc Xenon lamp.

In a preferred arrangement according to the invention in which the lamp is a low-pressure mercury vapour discharge lamp of 15 Watts at a maximum, and in which the input terminals are intended to be connected to an alternating voltage source of approximately 220 Volts, 50 Herz, the operating voltage of the lamp is between 25 and 35 Volts, and the value L of the inductor is less than 0.4 Henry.

An advantage of this preferred arrangement is that a very compact structural unit of lamp and ballast can be obtained. Such a unit may be used, for example, in a small luminaire for lighting a staircase step or the number of a house.

The lamp in an arrangement according to the invention has, for example, preheatable electrodes or no preheatable electrodes. If it has preheatable electrodes, the lamp is started with, for example, a glow-discharge starter.

In a further preferred arrangement according to the invention, in which the lamp is provided with two preheatable electrodes, the ends of the lamp electrodes remote from the alternating voltage source are connected together through a starter constituted as a voltage-sensitive uncontrolled semiconductor switching element.

In this connection "uncontrolled" is understood to mean: "Not provided with a control electrode".

An advantage of this preferred arrangement is that the starter may be very simple, lacking the complicated structure of moving parts.

The combination of the aforementioned starter, with a low L of the inductor of the ballast, is suitable for the operating condition of the lamp because the available low reignition voltage for the lamp can easily be maintained below the blocking voltage of the voltage-sensitive switching element.

In a special preferred arrangement according to the invention the said uncontrolled switching element consists of a series arrangement of two zener diodes whose blocking directions are opposite to each other.

This special preferred arrangement has the advantage of a starter which is very small in volume.

Figure 2:
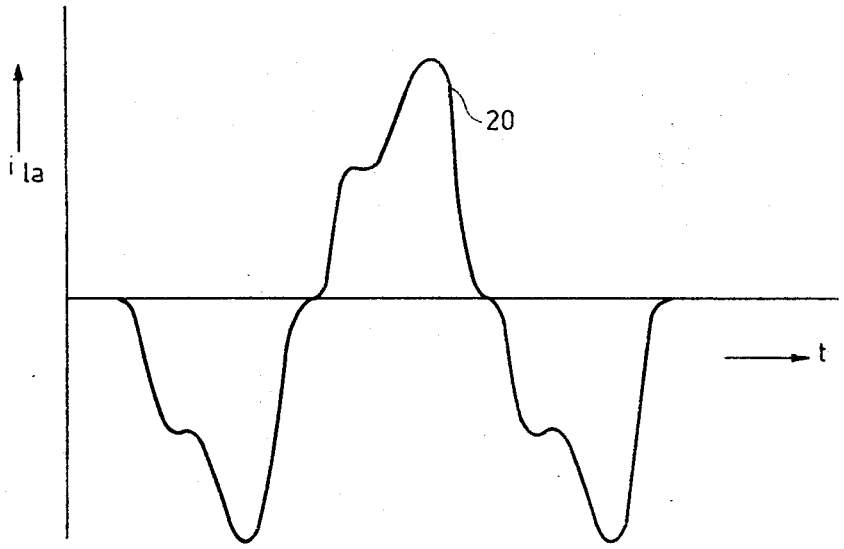
Figure 3:
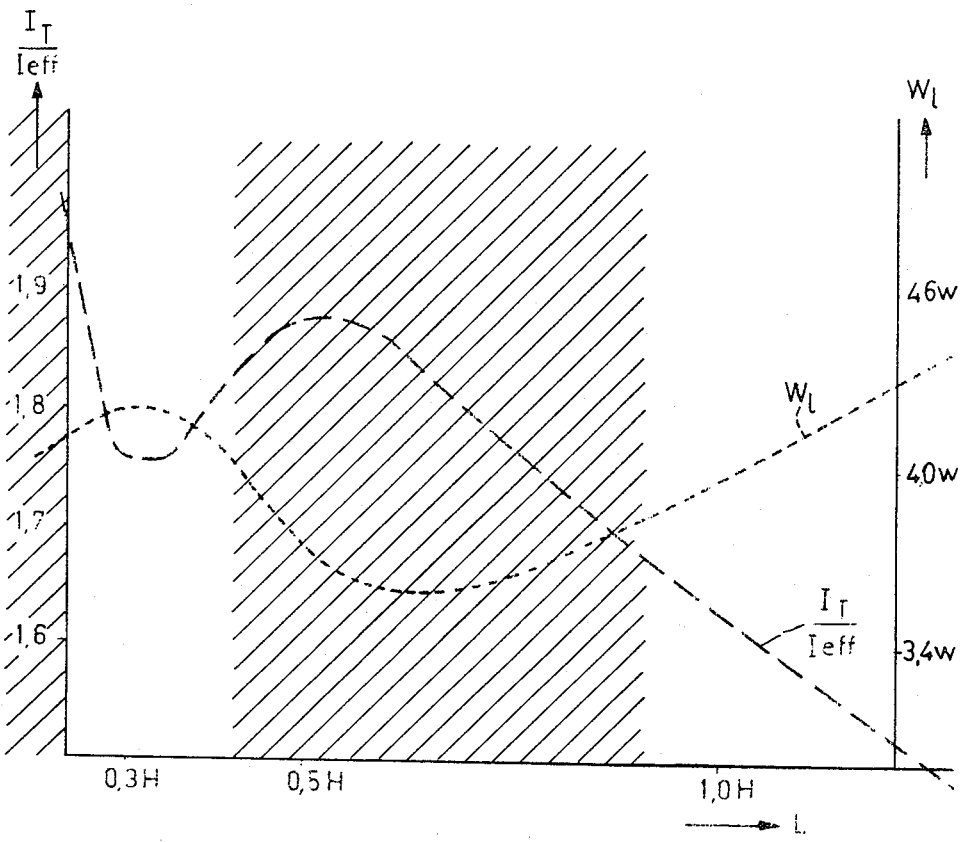

The invention will be described in greater detail with reference to the drawing, in which:

FIG. 1 shows an electrical circuit diagram of an arrangement according to the invention;

FIG. 2 shows the lamp current in the circuit of FIG. 1 as a function of time; and FIG. 3 shows a graph in which the peak factor of the total lamp current and the lamp watts are plotted against the value L of the inductor of the electric circuit of FIG. 1. It has been assumed that the value C of the capacitor changes simultaneously with the value L so that the total effective lamp current remains the same.

In FIG. 1 the reference numerals 1 and 2 denote input terminals intended to be connected to an alternating voltage source of 220 Volts, 50 Herz. Terminal 1 is connected to terminal 2 through a series arrangement of an inductor 3, a capacitor 4 and a low-pressure mercury vapour discharge lamp 5 of approximately 4 watts. Lamp 5 has two preheatable electrodes 6 and 7. The ends of electrodes 6 and 7 remote from the terminals 1 and 2 are connected together by a branch including two zener diodes 10 and 11 serially connected with opposite polarity. The values in this circuit are:

Inductance L of coil 3 is approximately 0.32 Henry;

capacitance C of capacitor 4 is approximately 2.1 $\mu$F;

operating voltage of lamp 5 is approximately 29 Volts (i.e. less than 20 percent of 220 Volts);

zener voltage of the zener diodes 10 and 11 is 35 Volts each; lamp current: approximately 16 m Ampere;

$$\pi f \sqrt{LC} = 0.129$$

which is between ⅛ and 1/7 = 0.125 and 0.143, respectively.

In FIG. 2 the reference numeral 20 denotes the lamp current as a function of time.

In FIG. 3 the reference $W_1$ and ($^{I}T/I_{eff}$) denote the lamp watts and the peak factor of the lamp current, respectively. The peak factor is the ratio between the peak value $^{I}T$ of the current and the effective value $I_{eff}$. The inductance L is plotted in Henry on the horizontal axis. The value of the peak factor is plotted on one vertical axis and the lamp watts are plotted on the other vertical axis.

It can be seen that in the region about $L = 0.32$ Henry the peak factor is relatively low and the lamp watts are relatively high, which is favourable for the lifetime of the lamp and for the quantity of the generated light radiation.

In FIG. 3 the shaded areas denote regions with an unstable operation.

In an arrangement that was not in accordance with the teachings of the invention, the relevant lamp of 4 Watts was inductively stabilised with an inductance of approximately 3 Henry, i.e. with an inductance that was approximately 10 times higher than that in the above-described embodiment according to the invention. In a circuit according to the invention this is offset by the introduction of a relatively small capacitor 4, but the total ballast in an arrangement according to the invention is smaller and has a smaller loss of watts. The wattage loss in the ballast (3 Henry) in the said arrangement not according to the invention was approximately 6 Watts. In contrast, the power loss is only approximately 1 Watt in the ballast (0.32 Henry and 2.1 $\mu$F) according to the invention (FIG. 1). This means, inter alia, that the total efficiency of the new arrangement, to wit the lamp together with the ballast, increases from approximately 15 lumens/Watt in an arrangement not according to the invention to a value of 30 Lumens/Watt in an arrangement according to the invention (see FIG. 1).

What is claimed is:

1. An arrangement for operating an electric discharge lamp comprising, two input terminals for applying a source of alternating voltage to said arrangement, an inductor, a capacitor, means connecting the series arrangement of the inductor, the capacitor and the lamp across said two input terminals, the combination of the inductor and the capacitor exhibiting a capacitive character at the frequency of the alternating voltage source, and wherein the operating voltage of the lamp is less than 20% of the effective value of the voltage of the alternating voltage source and the inductor and capacitor are chosen to satisfy the relation $$\tfrac{1}{8} < \pi f \sqrt{LC} < 1/7$$

wherein:

$f$ represents the frequency (in Herz) of the alternating voltage source;

$L$ is the value of the inductor (in Henry); and $C$ is the value of the capacitor (in Farad).

2. An arrangement as claimed in claim 1, in which the lamp comprises a low-pressure mercury vapour discharge lamp of 15 Watts maximum and in which the input terminals are intended to be connected to an alternating voltage source of approximately 220 Volts and approximately 50 Herz, characterized in that the operating voltage of the lamp is between 25 and 35 Volts, and the inductance value L of the inductor is less than 0.4 Henry.

3. An arrangement as claimed in claim 1 in which the lamp is provided with two preheatable electrodes, characterized in that the ends of the lamp electrodes remote from the alternating voltage source are connected together through a starter comprising a voltage-sensitive uncontrolled semiconductor switching element.

4. An arrangement as claimed in claim 3, characterized in that the uncontrolled switching element comprises a series arrangement of two zener diodes connected with opposite polarities to each other.

5. A supply circuit for an electric discharge lamp comprising, a pair of input terminals for applying an AC voltage of a frequency $f$ to the supply circuit, an inductor having an inductance value L, a capacitor having a capacitance value C, means connecting the inductor, the capacitor and the lamp in series circuit across the input terminals, the operating voltage of the lamp being less than 20 percent of the effective value of the AC voltage, and wherein the inductor and capacitor are chosen so that the capacitive reactance exceeds the inductive reactance at the frequency $f$ and the resonant frequency ($1/2\ \pi \sqrt{LC}$) lies between 3.5 and 4 times the frequency $f$ of the AC voltage.

6. A supply circuit as claimed in claim 5 wherein the lamp includes two preheatable electrodes, and an uncontrolled voltage sensitive switching element connected to the ends of the lamp electrodes remote from the input terminals.

7. A supply circuit as claimed in claim 6 wherein the switching element comprises two zener diodes serially connected with reverse polarity.

* * * * *